US010304425B1

(12) United States Patent
Rose

(10) Patent No.: US 10,304,425 B1
(45) Date of Patent: May 28, 2019

(54) SPEED GUIDE PLATE FOR GUITAR

(71) Applicant: Floyd D. Rose, Del Mar, CA (US)

(72) Inventor: Floyd D. Rose, Del Mar, CA (US)

( * ) Notice: Subject to any disclaimer, the term of this patent is extended or adjusted under 35 U.S.C. 154(b) by 0 days.

(21) Appl. No.: 16/047,443

(22) Filed: Jul. 27, 2018

(51) Int. Cl.

| | |
|---|---|
| ***G10D 3/18*** | (2006.01) |
| ***G10D 3/16*** | (2006.01) |
| *G10D 3/06* | (2006.01) |
| *G10D 3/04* | (2006.01) |
| *G10D 1/08* | (2006.01) |

(52) U.S. Cl.
CPC ..... *G10D 3/18* (2013.01); *G10D 3/16* (2013.01); *G10D 1/085* (2013.01); *G10D 3/04* (2013.01); *G10D 3/06* (2013.01)

(58) Field of Classification Search
CPC ..... G10D 3/18; G10D 3/16; G10D 1/085; G10D 3/06
See application file for complete search history.

(56) References Cited

U.S. PATENT DOCUMENTS

2016/0260420 A1* 9/2016 Jackson ..... G10D 3/14

OTHER PUBLICATIONS

Brubaker Musical Instruments, "Brubaker Guitar Gallery," http://www.brubakerguitars.com/gallery, 2018, accessed Oct. 25, 2018.
"The Willis Ramp," http://garywillis.com/pages/bass/bassmanual/theramp.html, accessed on Oct. 25, 2018.
Best Bass Gear, "What is a bass ramp and why would you want one?", https://www.bestbassgear.com/ebass/ideas/what-is-a-bass-ramp-and-why-would-you-want-one.html, accessed Oct. 25, 2018.

* cited by examiner

*Primary Examiner* — Kimberly R Lockett
(74) *Attorney, Agent, or Firm* — Lerner, David, Littenberg, Krumholz & Mentlik, LLP

(57) ABSTRACT

A guide plate configured to be coupled to or integrally formed with a guitar within a playing area of the guitar between a bridge and a base end of a neck. The guide plate can be configured to reveal, or cover over, the pickups and includes a body having an upper surface with a radius of curvature that substantially matches the fretboard radius of curvature of the guitar. The upper surface of the guide plate is elevated above a top surface of the guitar body by a predetermined distance to be substantially coextensive with the fretboard to provide a curved, depth limiting playing surface that matches the fretboard radius of curvature to limit the depth of travel of a pick between guitar strings and the upper surface of the guide plate in the playing area of the guitar.

20 Claims, 7 Drawing Sheets

SPEED GUIDE PLATE FOR GUITAR

BACKGROUND OF THE INVENTION

The present invention relates generally to improvements in stringed instruments such as guitars and, more particularly, relates to a device mounted to the playing area of a guitar between the bridge and the base of the neck in order to improve the picking speed of a player.

Musical instruments provide entertainment, social interaction, self-expression, and a source of livelihood for many people. Stringed instruments are especially popular because of their active playability, tonal properties, and portability.

Guitars are a type of stringed instrument. Guitarists may play the guitar with their fingers or a guitar pick, or a combination of both. Playing the guitar with a pick offers certain advantages or desired results and effects, including crispness of string vibration, desired tones from different pick gauges and pick styles, clarity of sound, ease of play, and especially speed of play, amongst others.

Popular music, such as rock and jazz music, often encompasses runs, riffs, scales, and arpeggios where a guitarist aims to pick the strings fast, at a high frequency. This is known as fast picking or speed picking. During picking, however, the pick can be susceptible to sliding off of the strings downwards towards the guitar body such that it is lowered too deep beneath the strings in the playing area following contact with the strings. This is especially the case for newer guitar players who have more difficulty manually controlling pick depth. Thus, when using a pick, the pick can be moved to depths between the strings and guitar body (or any pickguard in the playing area) making it difficult for the guitarist to pick the same string or another string as quickly as he or she may desire. Speed picking is thus a difficult technique for even more advanced guitarists that takes hours, days and years or practice to self-control the depth of the pick below the strings.

BRIEF SUMMARY OF THE INVENTION

In accordance with a first aspect of the present invention, an assembly is provided that includes a guitar with a speed guide plate mounted to the guitar, or integrally formed with the guitar, right below the strings that has a pick depth limiting upper surface which allows a guitarist to speed pick with much less effort than in the past by automatically controlling the maximum pick depth the pick travels below the strings in the playing area between the bridge and base of the neck.

One embodiment of the assembly includes a guitar and a guide plate coupled to the guitar. The guitar includes a body having a top surface, a neck having a top end, a base end, and a fretboard having a playing surface with a fretboard radius of curvature, and a bridge mounted on the top surface of the guitar body. The playing surface of the fretboard is elevated above the top surface of the guitar body. The guide plate is coupled to the guitar body and disposed between the bridge and the base end of the neck. The guide plate includes an upper surface having a radius of curvature at least within a playing area of the guitar between the bridge and the base end of the neck that substantially matches the fretboard radius of curvature. The upper surface of the guide plate is also elevated above the top surface of the guitar body to be substantially coextensive with the elevated playing surface of the fretboard to provide a curved, depth limiting playing surface that matches the fretboard radius of curvature to limit the depth of travel of a pick between the strings and the upper surface of the guide plate in the playing area of the guitar between the bridge and the base of the neck.

In a preferred embodiment, the guide plate extends continuously from the bridge to the base end of the neck. The upper surface or pick limiting surface of the guide plate may be convex in shape relative to the top surface of the guitar body. For example, the pick limiting surface of the guide plate may have a radius of curvature between 7 inches and 24 inches such that the radius of curvature of the pick limiting surface is equal to a radius of curvature of the fretboard.

The guitar may be an acoustic guitar or an electric guitar. In situations where the guitar is an electric guitar, the guide plate may optionally include at least one aperture for receiving a pickup.

The guide plate may be removeably attachable to the guitar body or a pickguard provided on the top surface of the guitar body. Alternatively, the guide plate may be integrally formed with the guitar body.

A guide plate configured to be coupled to a guitar within a playing area of the guitar between a bridge and a base end of a neck is also provided. The guide plate includes a body having an upper surface with a predetermined radius of curvature designed to substantially match a fretboard radius of curvature of the guitar such that the upper surface of the guide plate is elevated above a top surface of the guitar body a predetermined distance so as to be substantially coextensive with the fretboard to provide a curved, depth limiting playing surface that matches the fretboard radius of curvature to limit the depth of travel of a pick between guitar strings and the upper surface of the guide plate in the playing area of the guitar.

In another embodiment, a guitar assembly includes, a guitar having a guitar body with a top surface and a bottom surface opposite the top surface, a neck having a top end, a base end, and a fretboard having a playing surface, a bridge mounted to the guitar body, one or more pickups coupled to the guitar body adjacent the top surface of the guitar body, and a guide plate coupled to or formed as an integral part of the top surface of the guitar body. The playing surface of the fretboard may be elevated above the top surface of the guitar body. The guide plate may be coupled to, or be formed an integral part of, the top surface of the guitar body such that it covers over at least one of the one or more pickups and is disposed between the bridge and the base end of the neck. The guide plate includes an upper surface elevated above the top surface of the guitar body to limit the depth of travel of a pick between the strings and the upper surface of the guide plate in a playing area of the guitar between the bridge and the base of the neck.

The bottom surface of the guitar body may include one or more pockets or recesses for receiving the one or more pickups. The one or more pickups are coupled to the guitar body such that at least a portion of the one or more pickups is elevated above the top surface and extend into the guitar body right below the top surface of the speed guide plate.

The guide plate may be integrally formed with the wood or other material that forms the guitar body, or alternatively, the guide body may be removeably attachable to the guitar body. In a preferred embodiment, the upper surface of the guide plate has a radius of curvature at least within a playing area of the guitar between the bridge and the base end of the neck that substantially matches a fretboard radius of curvature.

DETAILED DESCRIPTION

Figure 1:
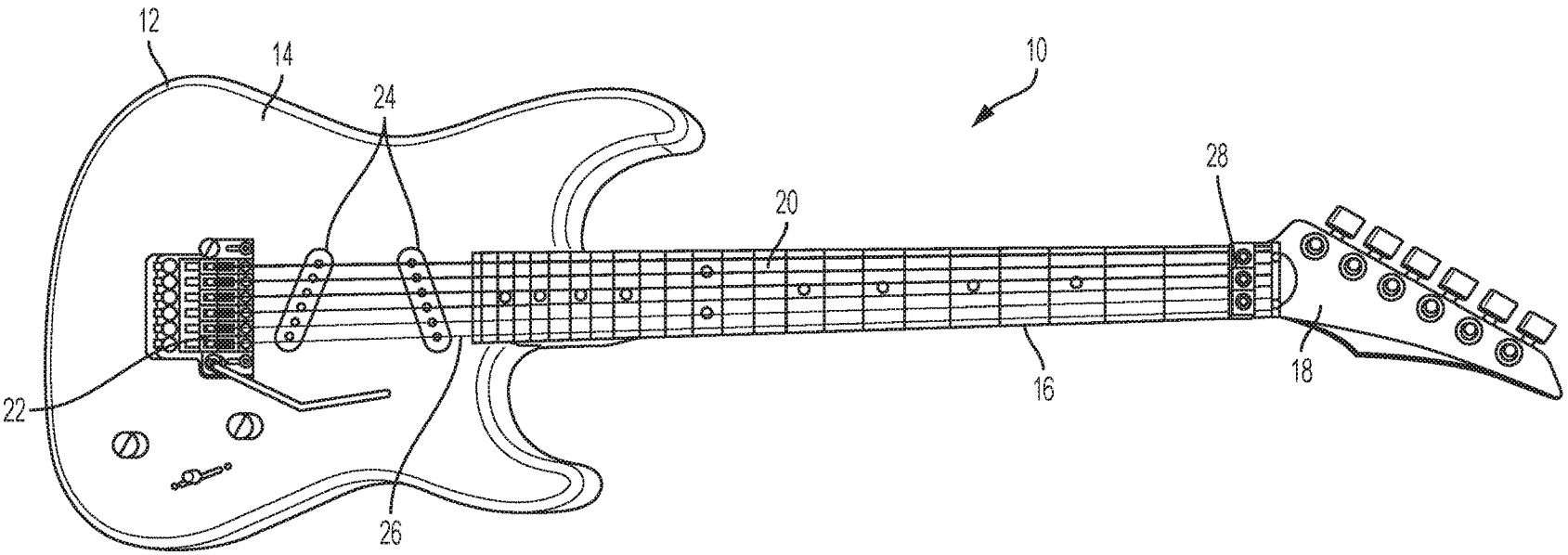
FIG. 1 PRIOR ART
FIG. 1 is a perspective view of a known electric guitar.
Figure 2:
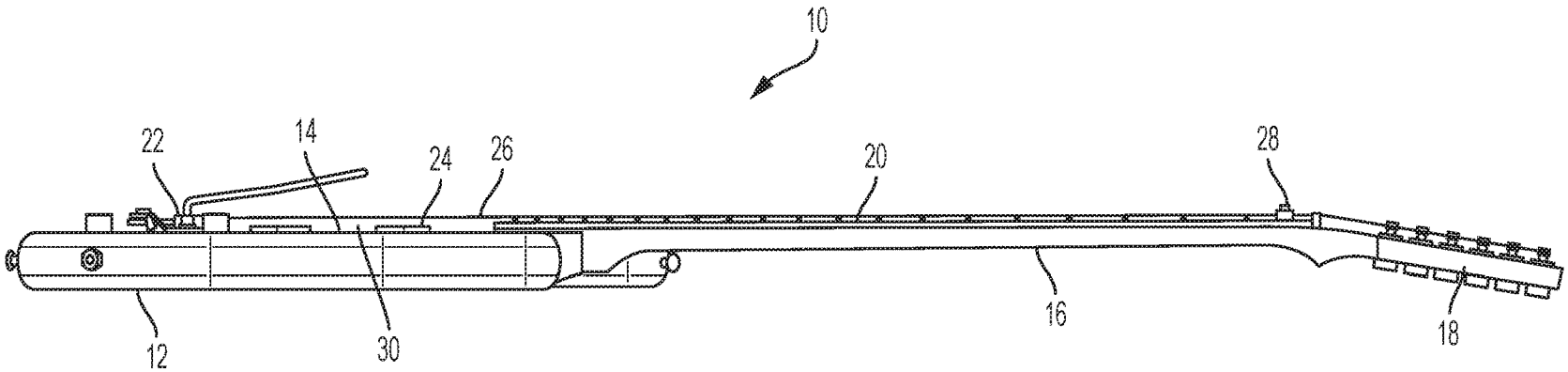
FIG. 2 PRIOR ART
FIG. 2 is a side view of the electric guitar of FIG. 1.

A typical electric guitar 10, an example of which is shown in FIGS. 1 and 2, includes a body 12 having a generally flat top surface 14, a neck 16 having a base end connected to the body, and a headstock 18 provided on a top end of the neck opposite the base end. Neck 16 is often secured to body 12 by fastening the neck within a neck pocket (not shown) defined in the body. Alternatively, neck 16 may be integrally formed with guitar body 12. In either scenario, a curved fretboard 20, provided on an upper surface of neck 16, is elevated at a distance above the top surface 14 of guitar body 12 as shown in FIG. 2.

A bridge 22 and one or more pickups 24 are mounted on the top surface 14 of guitar body 12. Strings 26 are secured between bridge 22 and a nut 28, located adjacent to headstock 18, such that picking the strings will cause the strings to vibrate and produce sound and corresponding musical notes. As the picked string vibrates over pickups 24, the pickups may carry the sound to an amplifier (not shown) which amplifies and disperses the sound. An upper surface of pickups 24 is typically elevated by a given distance above the top surface 14 of guitar body 12 and generally to a similar height as fretboard 20.

The height of bridge 22 is adjustable to raise or lower the "action" (i.e., the distance between the strings and the frets of the guitar) which alters the sound and tonal properties the guitar produces. Even when the action is in a relatively low position, the height of bridge 22 remains slightly higher than fretboard 20 so that there is clearance between strings 26 and the fretboard, which allows the strings to vibrate properly when fretted or picked. As shown in FIG. 2, this results in a gap 30 between strings 26 and the top surface 14 of guitar body 12. The size of the gap also increases when the action is raised.

During picking in the playing area between the base of the neck and the bridge, in the area of the pickups, the pick is susceptible to sliding off of strings 26 downwards toward guitar body 12. Pick slippage can be especially problematic during speed picking as the guitarist is picking at a higher frequency and needs to control the depth of the pick. When the pick moves or slides below the strings into gap 30 (i.e., too close to the top surface 14 of body 12) the guitarist usually cannot pick the next string as quickly as he or she may desire.

The device described hereinafter as a "guide plate" is adapted to assist a guitarist in speed picking. More specifically, the device is adapted to be mounted on an electric guitar within a playing area of the guitar to act as "pick limiter" with a surface that matches the radius of curvature of the neck, which allows limiting the depth of travel of a pick between into the gap (i.e., between the strings and guitar body or pickguard) during picking. Matching the radius of curvature of the guide plate to that of the fretboard allows the guitarist to have a feel of an extension the neck and maintains a consistent string depth for each string to the fretboard and guide plate, as each string is typically adjustable in height or action individually to match the radius of curvature of the fretboard. While the guide plate is described as being mounted on an electric guitar, it will be appreciated that these concepts are equally applicable to an acoustic guitar or other like stringed instruments played with a pick.

Figure 3:
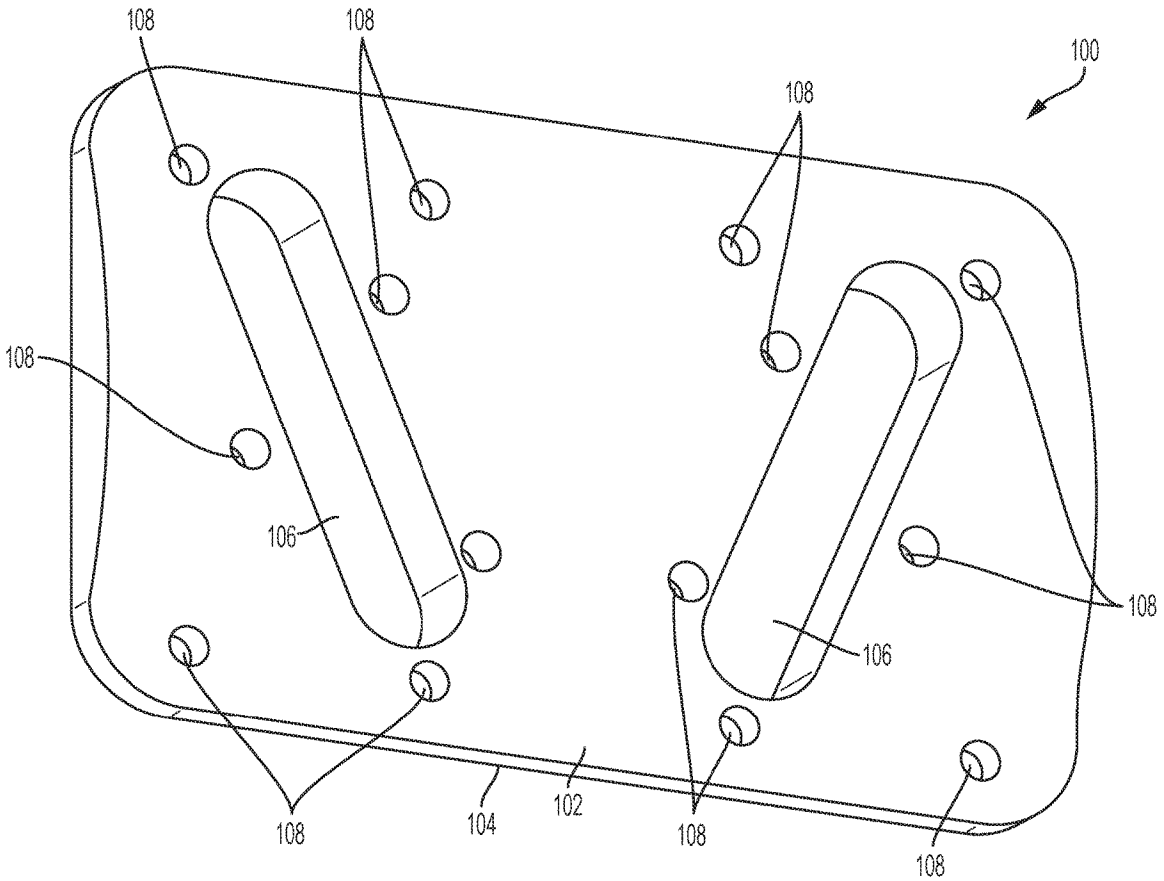
FIG. 3 is a front perspective view of a guide plate according to an embodiment of the present disclosure.
Figure 4:
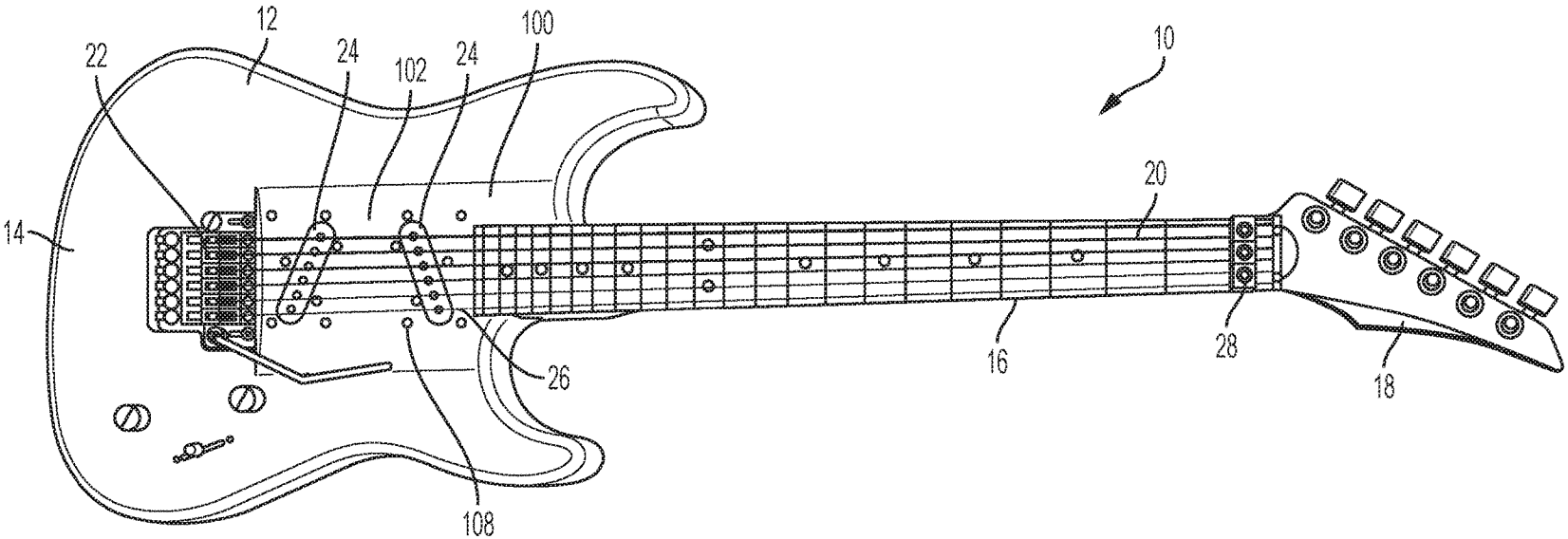
FIG. 4 is a front perspective view of the guide plate of FIG. 3 coupled to an electric guitar.
Figure 5:
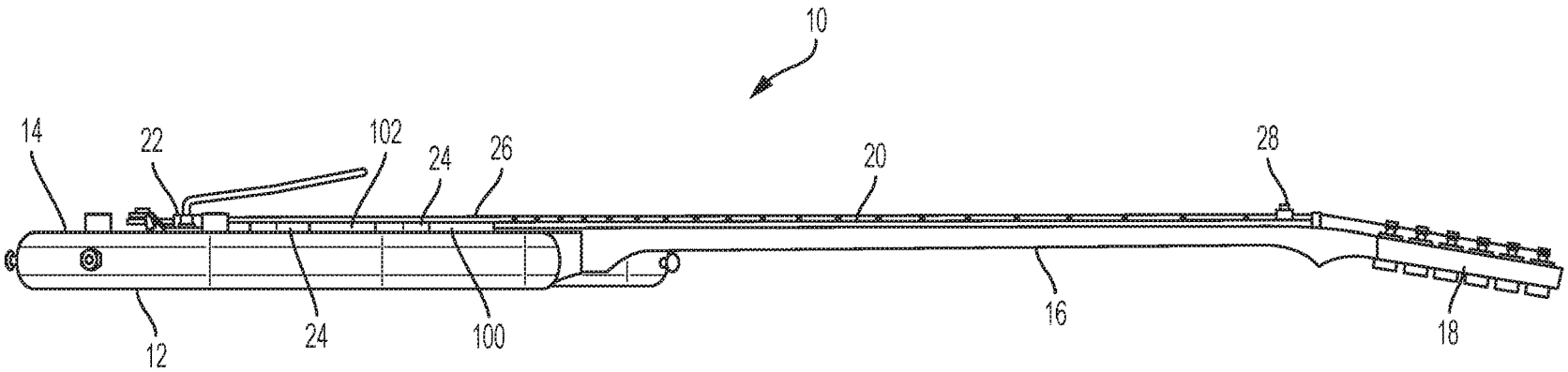
FIG. 5 is a side view of the guitar speed guide assembly of FIG. 4.

FIG. 3 illustrates an exemplary guide plate 100 configured to be connected to electric guitar 10 as shown in FIGS. 4 and 5. Guide plate 100 may be formed of wood, plastic, metal, or any other material known in the art, and may have a solid or hollow body. Guide plate 100 includes an upper or pick limiting surface 102, and an opposing bottom surface 104 defining a height therebetween. Bottom surface 104 may be planar so that guide plate 100 sits flush on the top surface 14 of guitar body 12 or a pickguard sometimes mounted flush to the guitar body to prevent scratching or marring of the finish of the guitar by picking.

Referring to FIG. 4, guide plate 100 is coupled to guitar body 12 between bridge 22 and a base end of neck 16. As is shown in FIG. 5, pick limiting surface 102 is raised a distance above the top surface 14 of guitar body 12, and has a radius of curvature that matches the radius of curvature of the fretboard. Consequently, clearance under strings 26 is reduced in a manner fully consistent with the radius of curvature of the fretboard to provide a consistent pick-limiting height corresponding to the action of height that is set for each string. In the event that the pick slips off of strings 26 during picking, pick limiting surface 102 will prevent the pick from being inserted too deep between the strings and the guitar body or pickguard and picking frequency can be vastly improved.

Unlike a pickguard, which has a low profile and is designed to protect the guitar body 12 from damage, guide plate 100 is designed to have its upper surface raised above the guitar body and any pickguard such that pick limiting surface 102 is raised above the top surface 14 of guitar body 12 and above any pickguard located in the playing area between the bridge and base of the neck, and is preferably elevated to be substantially the same height as fretboard 20, and preferably curved to match the radius of curvature of the fretboard, to thereby minimizing clearance under strings 26 and provide a consistent minimized clearance for each individual string.

In a preferred embodiment, guide plate 100 extends continuously from bridge 22 to neck 16. Pick limiting surface 102 may be flat or convex in shape such that its radius of curvature matches the radius of curvature of the fretboard and is, for example, between 7 inches and 24 inches. The radius of curvature of pick limiting surface 102 can be designed to correspond to the radius of curvature of fretboard 20 to provide a uniform pick-limited playing surface between the bridge and the base of the neck, allowing the guitarist to speed pick strings 26 at any location in the playing area between the bridge and base of the neck.

Some fretboards have a compound radius in that the fretboard has a first radius of curvature at a top end of neck 16 and a second radius of curvature near a base end of the neck. A compound radius fretboard may, for example, have a radius of curvature of 12 inches at the top end of the neck, a gradually increasing radius along its length, and a 24 inch radius of curvature at the base of the fretboard. In situations in which the fretboard has a compound radius of curvature, the radius of curvature of guide plate 100 will preferably match the radius of curvature of the base end of the fretboard, providing a uniform surface where the two components meet. It is, however, also contemplated that the radius of curvature of guide plate 100 may be within a range of the compound radius of curvature of the fretboard such that the radius of curvature of the guide plate is between a lowest radius of curvature of the fretboard and a highest radius of curvature of the fretboard, such that in the above example, the radius of curvature of the guide plate may be between 12 and 24 inches.

Guide plate 100 may optionally include one or more pickup apertures 106 configured to receive pickups 24. The illustrated shape of apertures 106 are merely exemplary. It will be understood that the apertures 106 may be other sizes and/or shapes to accommodate differently sized and/or shaped pickups. When guide plate 100 is coupled to the guitar, pickups 24 extend into apertures 106 such that a top surface of the pickups are substantially flush with, or below, pick limiting surface 102.

Guide plate 100 may optionally include a plurality of holes 108 configured to receive fasteners, such as screws or bolts, for fastening guide plate 100 to guitar 10, although any suitable forms of attachment or attachment mechanisms may also be used to secure the guide plate in place. Guide plate 100 may be removably attachable, permanently affixed, or integrally formed with the guitar. It will be appreciated that holes 108 are not necessary if the guide plate is attached to the guitar via other ways, for example, by gluing, press fitting, clips, etc. or if the guide plate is integrally formed with the guitar body.

Figure 6:
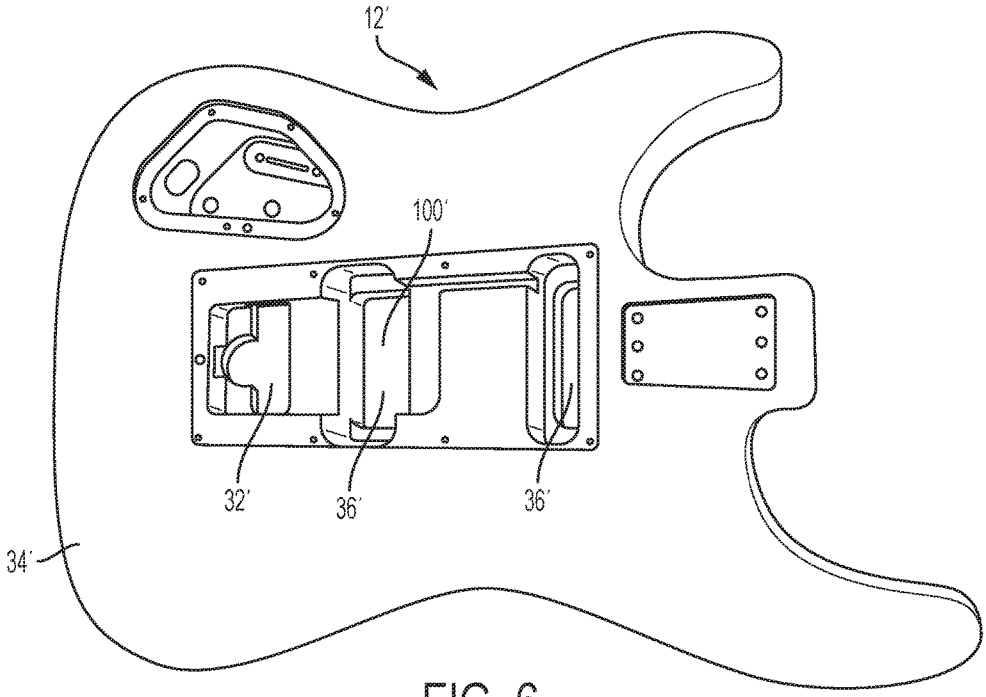
FIG. 6 is a rear perspective view of a guitar body with an integrally formed guitar speed guide formed on the top surface of the guitar according to another embodiment of the present disclosure.
Figure 7:
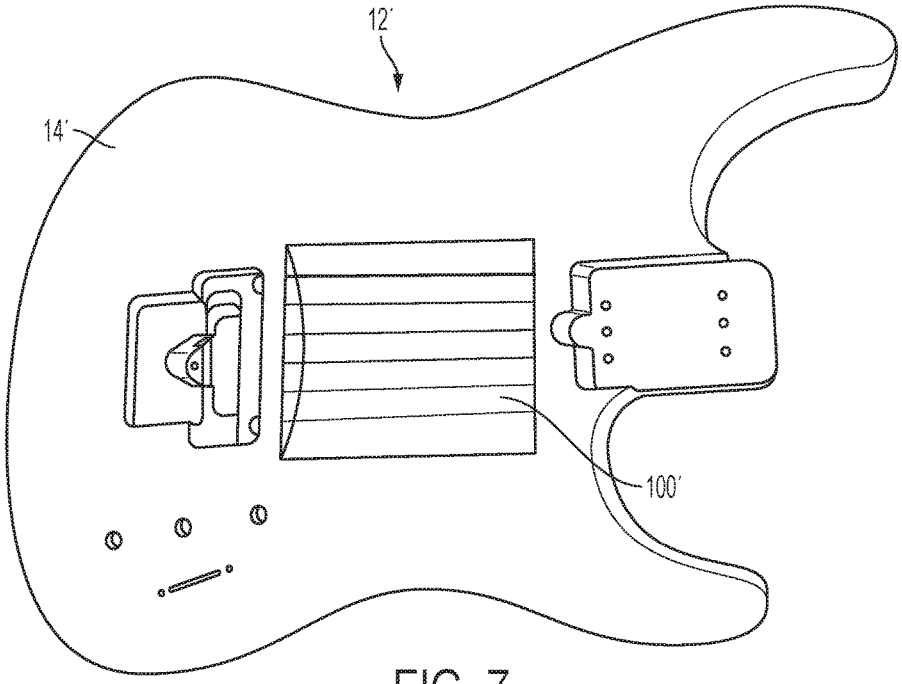
FIG. 7 is a front perspective view of the guitar body of FIG. 6.
Figure 8:
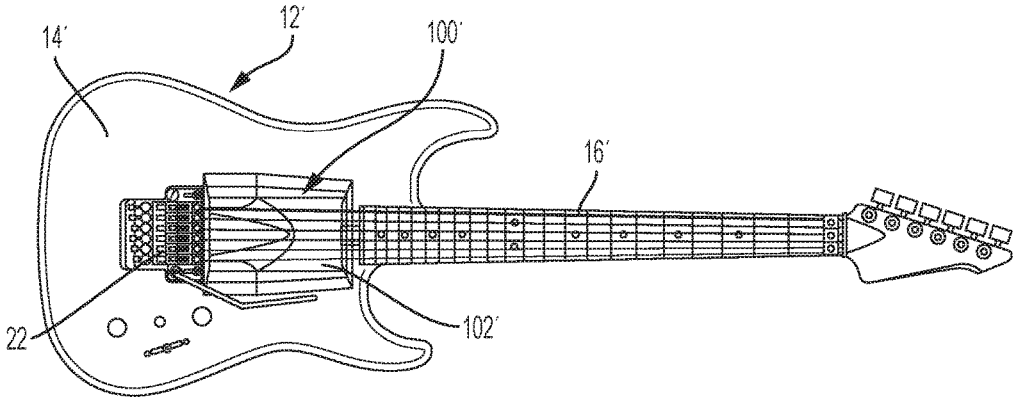
FIG. 8 is a front perspective view of an assembled guitar including the guitar body of FIG. 6.

FIGS. 6-8 illustrate a modified guitar body 12' configured to conceal pickups 24 underneath speed plate 100', which may be flat or curved. Guitar body 12' includes a generally flat top surface 14' (see FIG. 7) which may include a neck pocket in the top surface for fastening a neck 16' to the guitar body. Guitar body 12' includes an aperture 32' extending through the guitar body. Apertures 32' is sized and shaped such that bridge 22 can be mounted to guitar body 12' through a bottom surface '34 of the guitar body. Guitar body 12' may also include one more recesses 36' extending at least partially through the bottom surface 34' of the guitar body but not extending through to the front surface of the guitar. Recesses 36' are be sized and shaped such that pickups 24 can be mounted to guitar body 12' by inserting the pickups into apertures 36' from a bottom surface '34 of the guitar body. In this manner, and as shown in FIG. 8, guide plate 100' covers the one or more pickups such that there is no contact of the pickups by the guitar pick as the guitarist is picking in the area of the pickups and speed guide.

Guide plate 100' is similar to guide plate 100 and may be removably attachable, permanently affixed, or integrally formed with guitar body 12'. It will be appreciated that adjustments may be made to bridge 22 and/or pickups 24 without having to remove guide plate 100' (if the guide plate is configured to be removed). In order to make an adjustment to bridge 22 and/or pickups 24, a guitarist or technician can access the bridge and/or pickups through aperture 32' and/or recesses 36' provided in the bottom surface 34' of guitar body 12'.

Pickups 24 may be inserted within recesses 36' such that the pickups at least partially extend through the top surface 14' of guitar body 12' and into the hollow body of speed guide 100'. As is shown in FIG. 8, pickups 24 may thus be completely concealed underneath pick guide 100', alleviating the need for speed guide 100' to include pickup apertures and providing a smooth, uninterrupted speed guide playing area that includes the areas directly over the pickups. Pickups 24 may extend through to the under surface of the speed guide and touch, or be slightly spaced from, the under surface.

With guide plate 100 disposed in the playing areas of the guitar 10 between the bridge and base of the neck, the picking ability of the guitarist can be greatly improved because the guide plate limits the depth that the pick travels between the strings 26 and body of the guitar or pickguard, and thus, cuts down the distance the pick has to travel upwards to pick the same string or a subsequent string.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A guitar assembly comprising:

a guitar including a guitar body having a top surface, at least one pickup, a neck having a top end, a base end, and a fretboard having a playing surface with at least one fretboard radius of curvature, and a bridge mounted on the top surface of the guitar body, the playing surface of the fretboard being elevated above the top surface of the guitar body; and a guide plate coupled to the guitar body and extending continuously from the bridge to the base end of the neck and having at least one aperture that extends completely through the guide plate and surrounds the at least one pickup, the guide plate including an upper surface having a radius of curvature at least within a playing area of the guitar between the bridge and the base end of the neck that substantially matches the fretboard radius of curvature, and wherein the upper surface of the guide plate is elevated above the top surface of the guitar body and substantially to the same height as the elevated playing surface of the fretboard to provide a curved, depth limiting playing surface that matches or is within a range of the at least one fretboard radius of curvature to limit the depth of travel of a pick between the strings and the upper surface of the guide plate in the playing area of the guitar between the bridge and the base of the neck.

2. The assembly of claim 1, wherein the upper surface of the guide plate is convex in shape relative to the top surface of the guitar body located between the bridge and the base end of the neck.

3. The assembly of claim 1, wherein the radius of curvature of the guide plate is between 7 inches and 24 inches.

4. The assembly of claim 1, wherein the guide plate is provided between at least a front and back pickup on the guitar.

5. The assembly of claim 1, wherein the guitar comprises two pickups and the guide plate includes two apertures that surround each of the pickups disposed on the guitar between the bridge and the base end of the neck.

6. The assembly of claim 1, wherein the guide plate is removeably attachable to the guitar body or to a pickguard provided on the top surface of the guitar body.

7. The assembly of claim 1, wherein the guide plate is integrally formed with the guitar body.

8. The assembly of claim 1, wherein at least one of the apertures in the guide plate comprises a rectangular slot formed at an angle to accommodate a pickup disposed on the guitar body at an angle to the fretboard.

9. The assembly of claim 1, wherein the guitar is an electric guitar.

10. A guide plate configured to be coupled to a guitar within a playing area of the guitar between a bridge and a base end of a neck, the guide plate comprising:

a body including an upper surface having a predetermined radius of curvature designed to substantially match a radius of curvature of the neck of the guitar or be within a range of radii of curvature of the neck of the guitar, the body defining at least one recess configured to surround a guitar pickup, wherein when attached to the guitar the upper surface of the guide plate is disposed above a top surface of the guitar body by a predetermined distance so as to be substantially coextensive with the neck to provide a curved, depth limiting playing surface to limit the depth of travel of a pick between guitar strings and the upper surface of the guide plate in the playing area of the guitar.

11. The guide plate of claim 10, wherein the upper surface of the guide plate is convex in shape and the radius of curvature of the upper surface substantially matches the radius of curvature of the base end of the neck.

12. The assembly of claim 10, wherein the radius of curvature of the guide plate is between 7 inches and 24 inches.

13. The assembly of claim 10, wherein the at least one recess comprises an aperture that extends completely through the body from a bottom surface of the body to the top surface of the body.

14. The assembly of claim 10, wherein the guide plate includes one or more holes configured to receive one or more fasteners for connecting the guide plate to a guitar.

15. A guitar assembly comprising:

a guitar including a guitar body having a top surface and a bottom surface opposite the top surface, a neck having a top end, a base end, and a fretboard having a playing surface, a bridge mounted to the guitar body, and one or more pickups coupled to the guitar body adjacent the top surface of the guitar body, the bottom surface of the guitar body having one or more recesses for receiving the one or more pickups, the playing surface of the fretboard being elevated above the top surface of the guitar body; and a guide plate disposed on the top surface of the guitar body covering over at least one of the one or more pickups and located between the bridge and the base end of the neck, the guide plate including an upper surface elevated above the top surface of the guitar body and substantially to a height of the fretboard to limit the depth of travel of a pick between the strings and the upper surface of the guide plate in a playing area of the guitar between the bridge and the base of the neck.

16. The assembly of claim 15, wherein the one or more pickups are provided at least partially within a hollow cavity of the guide plate and beneath an upper surface of the guide plate.

17. The assembly of claim 15, wherein the guide plate is integrally formed with the guitar body.

18. The assembly of claim 15, wherein the guide plate is removeably attachable to the guitar body.

19. The assembly of claim 15, wherein the upper surface of the guide plate is substantially flat and parallel to the top surface of the guitar body.

20. The assembly of claim 15, wherein the fretboard has a radius of curvature and wherein an upper surface of the guide plate has a radius of curvature at least within a playing area of the guitar between the bridge and the base end of the neck that substantially matches the fretboard radius of curvature.

* * * * *